US010512373B1

(12) United States Patent
White

(10) Patent No.: US 10,512,373 B1
(45) Date of Patent: Dec. 24, 2019

(54) SOAP DISPENSER DRIP CATCHER

(71) Applicant: Darlene White, Hesperia, CA (US)

(72) Inventor: Darlene White, Hesperia, CA (US)

( * ) Notice: Subject to any disclaimer, the term of this patent is extended or adjusted under 35 U.S.C. 154(b) by 0 days.

(21) Appl. No.: 16/031,136

(22) Filed: Jul. 10, 2018

(51) Int. Cl.
*A47K 5/12* (2006.01)
*A47K 17/00* (2006.01)

(52) U.S. Cl.
CPC ..... *A47K 17/00* (2013.01); *A47K 5/1211* (2013.01); *A47K 2201/02* (2013.01)

(58) Field of Classification Search
CPC ..... B65B 67/12; Y10T 137/5835; B67D 1/16; B65D 47/40; B65D 23/065; B65D 23/06
USPC ..... 222/108; 137/312
See application file for complete search history.

(56) References Cited

U.S. PATENT DOCUMENTS 2,732,024 A * 1/1956 Schonwald ..... F01M 11/04 180/69.1
4,603,432 A * 7/1986 Marino ..... B65D 88/1618 137/312
5,915,839 A 6/1999 Dennis
6,279,781 B1 8/2001 Konar
6,330,990 B1 * 12/2001 Haubrich ..... B65B 67/12 248/101
D614,442 S 4/2010 Smith
2009/0140004 A1 6/2009 Scorgle
2014/0076405 A1 * 3/2014 McMillen ..... E04G 21/24 137/1
2015/0083754 A1 3/2015 Proper
2016/0316975 A1 * 11/2016 Ophardt ..... A47K 5/1202
2017/0318964 A1 11/2017 McKnight

FOREIGN PATENT DOCUMENTS

WO 2013063690 5/2013

* cited by examiner

*Primary Examiner* — Paul R Durand
*Assistant Examiner* — Robert K Nichols, II

(57) ABSTRACT

The soap dispenser drip catcher comprises a bag holder and a soap collection bag. The bag holder attaches to a wall-mounted liquid soap dispenser and suspends the soap collection bag under the soap dispenser. In an embodiment, the bag holder comprises a front frame and a rear frame which are each U-shaped armatures that are separated from each other by two springs. The front frame and rear frame hang from mounting holes in the soap dispenser using hooks at the upper end of each arm of the frames. A bag attachment comprising a plurality of clips are located at the bottom of the bag holder. The clip removably hold the soap collection bag in place. In another embodiment, the hooks at the top of the bag holder are replaced by a net that rests on the top of the soap dispenser.

15 Claims, 5 Drawing Sheets

SOAP DISPENSER DRIP CATCHER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of bathroom fixtures, more specifically, a soap dispenser drip catcher.

SUMMARY OF INVENTION

The soap dispenser drip catcher comprises a bag holder and a soap collection bag. The bag holder attaches to a wall-mounted liquid soap dispenser and suspends the soap collection bag under the soap dispenser. In an embodiment, the bag holder comprises a front frame and a rear frame, which are each U-shaped armatures that are separated from each other by two springs. The front frame and rear frame hang from mounting holes in the soap dispenser using hooks at the upper end of each arm of the frames. A bag attachment comprising a plurality of clips are located at the bottom of the bag holder. The clip removably hold the soap collection bag in place. In another embodiment, the hooks at the top of the bag holder are replaced by a net that rests on the top of the soap dispenser.

An object of the invention is to suspend a soap collection bag beneath a liquid soap dispenser.

Another object of the invention is to attach a bag holder to the soap dispenser using either hooks and mounting holes or a net.

A further object of the invention is to provide clips at the bottom of the bag holder to removably attach a bag to the bag holder.

Yet another object of the invention is to provide a resealable bag with a spout for use with the bag holder.

These together with additional objects, features and advantages of the soap dispenser drip catcher will be readily apparent to those of ordinary skill in the art upon reading the following detailed description of the presently preferred, but nonetheless illustrative, embodiments when taken in conjunction with the accompanying drawings.

In this respect, before explaining the current embodiments of the soap dispenser drip catcher in detail, it is to be understood that the soap dispenser drip catcher is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the soap dispenser drip catcher.

It is therefore important that the claims be regarded as including such equivalent construction insofar as they do not depart from the spirit and scope of the soap dispenser drip catcher. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
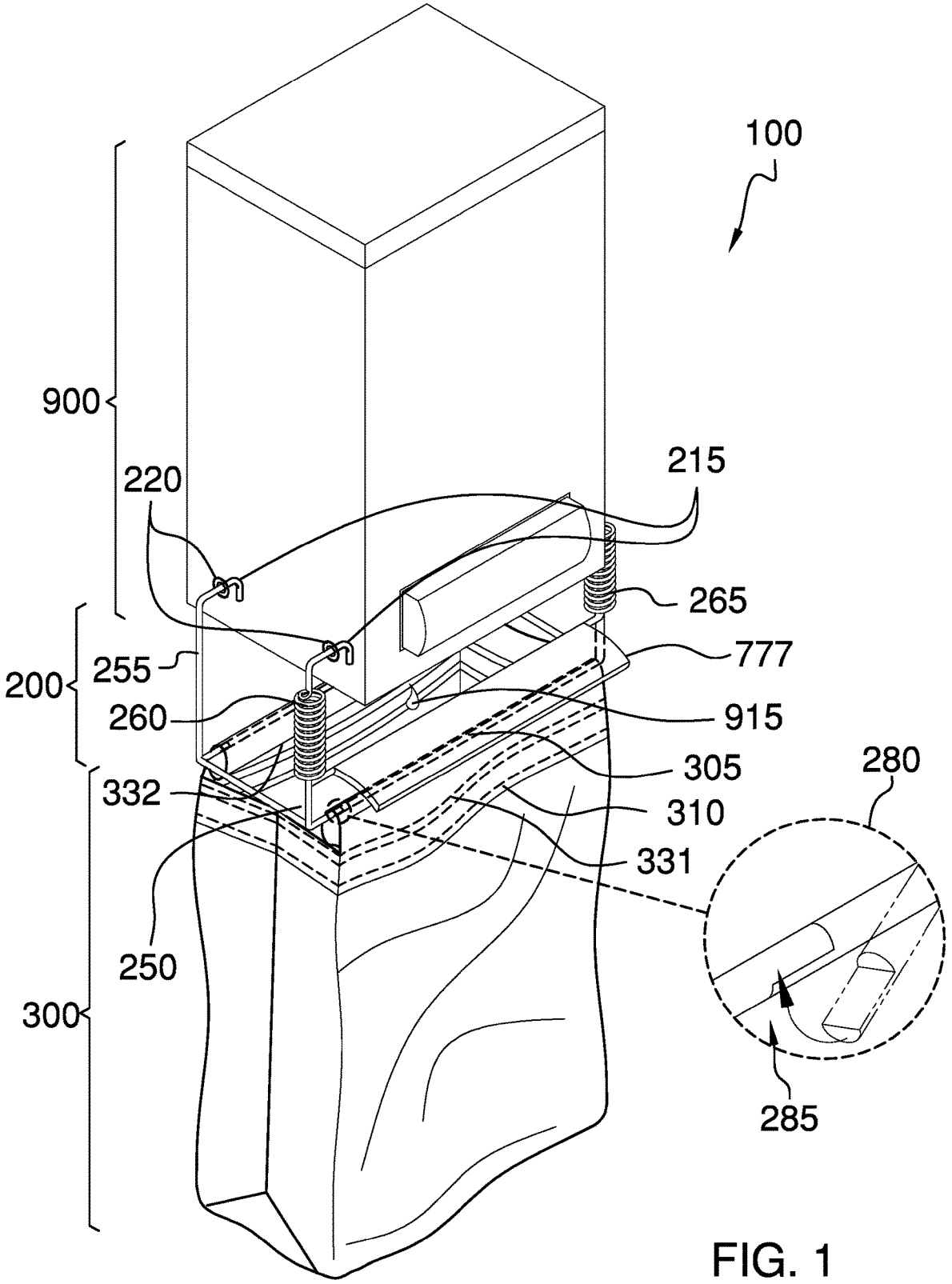
FIG. 1 is a perspective view of an embodiment of the disclosure.
Figure 2:
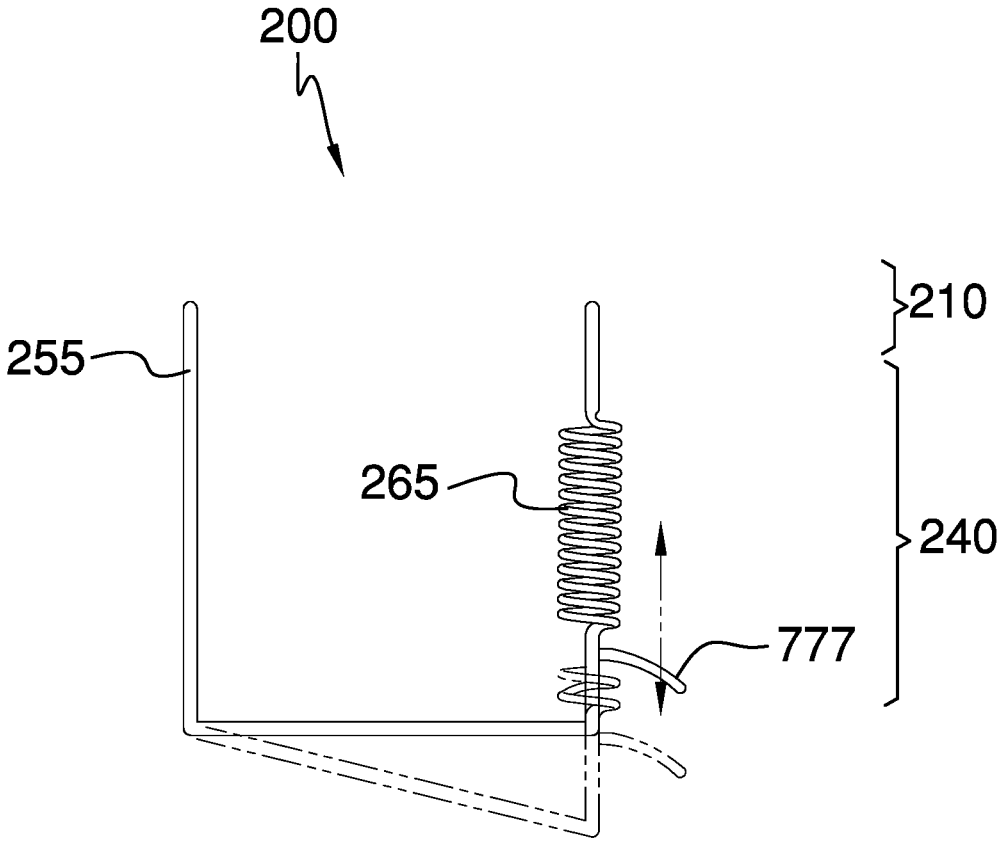
FIG. 2 is a side view of an embodiment of the disclosure showing the bag holder.
Figure 3:
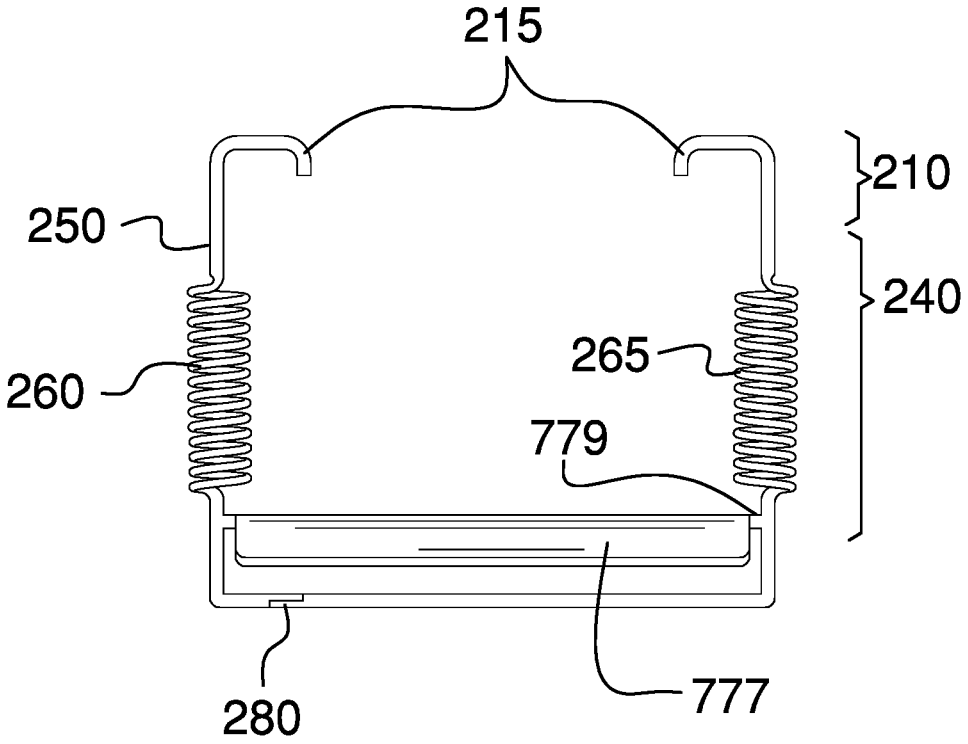
FIG. 3 is a front view of an embodiment of the disclosure showing the bag holder.
Figure 4:
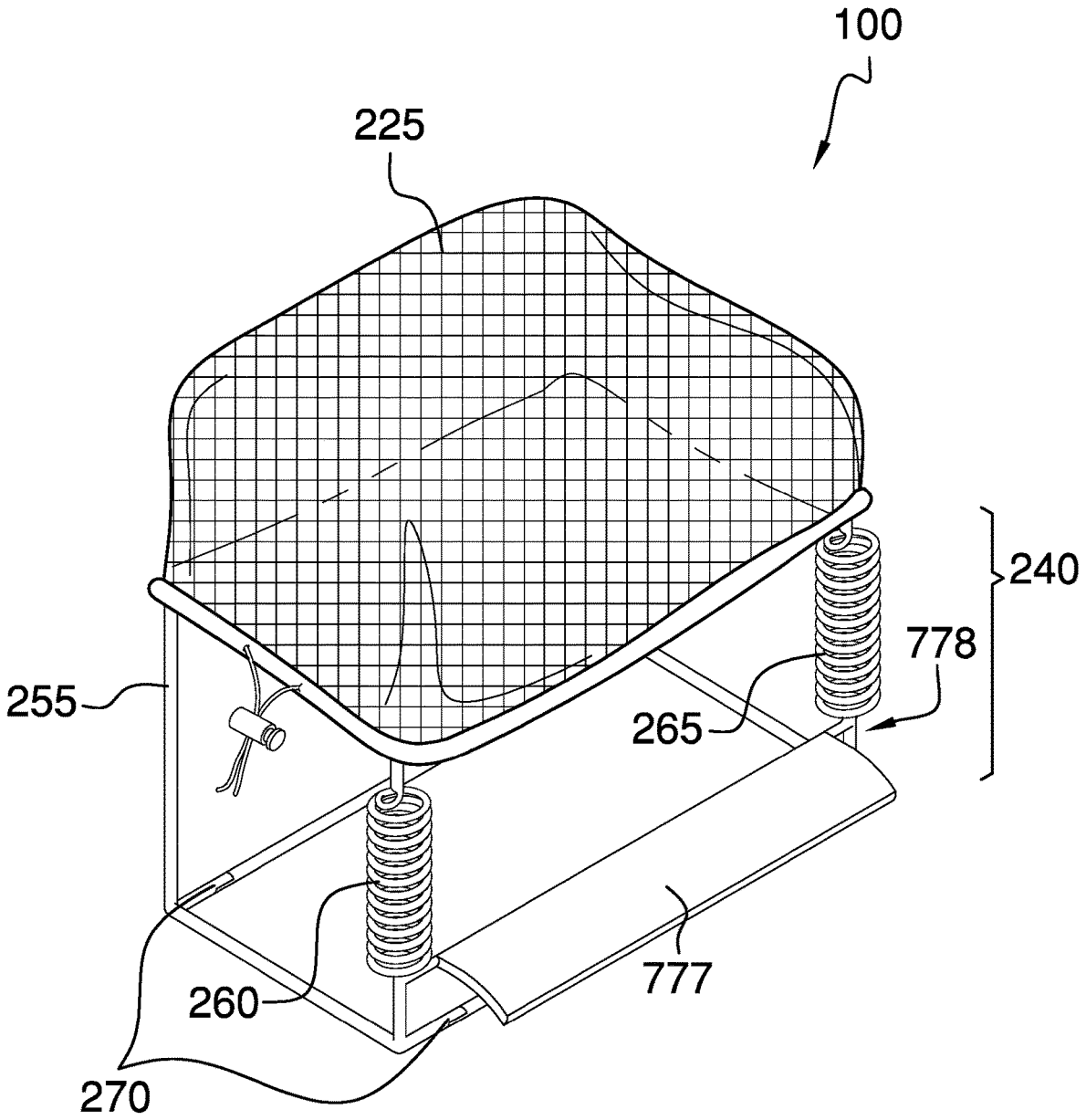
FIG. 4 is a perspective view of an alternative embodiment of the disclosure.
Figure 5:
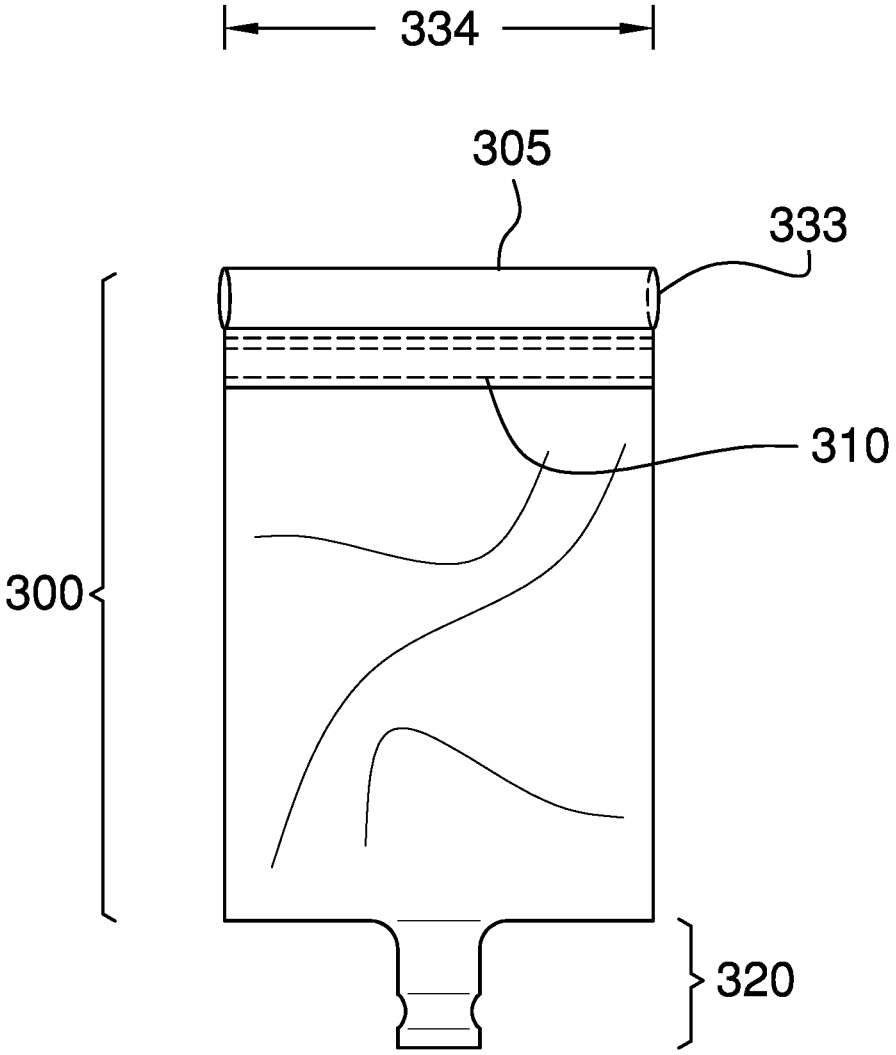
FIG. 5 is a detail view of an embodiment of the disclosure showing the soap collection bag.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 5.

The soap dispenser drip catcher 100 (hereinafter invention) comprises a bag holder 200 and a soap collection bag 300. The bag holder 200 holds the soap collection bag 300 below a liquid soap dispenser 900 where the soap collection bag 300 may collect soap that drips 915 from the liquid soap dispenser 900. The soap collection bag 300 may prevent the drips 915 from contaminating a floor under the liquid soap dispenser 900.

The bag holder 200 comprises a hanger 240, a bag attachment 270, and a dispenser attachment 210. The hanger 240 may be adapted to allow a hand of a user (not illustrated in the figures) to receive the soap from the liquid soap dispenser 900 by providing empty space between the liquid soap dispenser 900 and the soap collection bag 300.

The hanger 240 may comprise a front frame 250 and a rear frame 255. The front frame 250 and the rear frame 255 may define the vertical separation distance between the liquid soap dispenser 900 and the soap collection bag 300.

The front frame 250 may comprise a U-shaped, resilient armature. The orientation of the front frame 250 may be such that the opening of the U-shaped armature is at the top. Two parallel vertical sides of the U may run from the top of the front frame 250 to the bottom of the front frame 250 where they couple to opposite sides of a horizontal cross brace which forms the bottom of the U. The two parallel vertical sides of the U may be located on the right side and the left side of the front frame 250. The vertical height of the two parallel vertical sides of the U may be at least 2 inches long to provide access to the soap dispensed by the liquid soap dispenser 900.

The rear frame 255 may comprise a U-shaped, resilient armature. The orientation of the rear frame 255 may be such that the opening of the U-shaped armature is at the top. Two parallel vertical sides of the U may run from the top of the rear frame 255 to the bottom of the rear frame 255 where they couple to opposite sides of a horizontal cross brace which forms the bottom of the U. The two parallel vertical sides of the U may be located on the right side and the left side of the rear frame 255. The vertical height of the two parallel vertical sides of the U may be at least 2 inches long to provide access to the soap dispensed by the liquid soap dispenser 900.

The hanger 240 may further comprise a left spring 260 and a right spring 265. The left spring 260 extends upwardly from a left side of the front frame 250. The right spring 265 extends upwardly from a right side of the front frame 250. The left spring 260 and the right spring 265 may be vertically oriented along a front of the hanger 240.

The bag attachment 270 may removably couple the soap collection bag 300 to the hanger 240. The bag attachment 270 may be a plurality of interlocking arms 280 coupled to the bottom of the hanger 240. The plurality of interlocking arms 280 may be located at the front frame 250 and the rear frame 255 of the hanger 240.

Referring to FIG. 1, each of the plurality of interlocking arms 280 may be rotated away from one another to form a separation 285 in the front frame 250 or the rear frame 255. The separation 285 of each of the plurality of interlocking arms 280 enables the soap collection bag 300 to be secured thereto or released therefrom. The soap collection bag 300 is further defined with a top edge 305 as well as a resealable opening 310. Situated below the top edge 305, and along a first surface 331 and a second surface 332 of the soap collection bag 300 is a sleeved member 333. The sleeved member 333 extends along a width 334 of the soap collection bag 300. The front frame 250 and the rear frame 255 slide into the sleeved member 333 via the plurality of interlocking arms 280.

The front frame 250 and the rear frame 255 hold the top of the soap collection bag 300 open so that the drips 915 may fall into the soap collection bag 300. The bag holder 200 may couple the top of the hanger 240 to the liquid soap dispenser 900.

In some embodiments, the top ends of the front frame 250 and the top ends of the rear frame 255 may bend 90 degrees towards the center of the liquid soap dispenser 900 to form a plurality of hooks 215. The plurality of hooks 215 may be inserted into a plurality of mounting apertures 220 drilled or preformed in the sides of the liquid soap dispenser 900. The hanger 240 may hang down from the liquid soap dispenser 900 by the plurality of mounting apertures 220 as shown in FIG. 1.

In some embodiments, the hanger 240 may comprise a net 225. The net 225 may be a mesh fabric. The net 225 may couple to the top ends of the front frame 250 and to the top ends of the rear frame 255. See FIG. 2. The net 225 may be placed over the top of the liquid soap dispenser 900 and the hanger 240 may hang from the net 225.

The soap collection bag 300 may be a flexible, waterproof container comprising the resealable opening 310. As a non-limiting example, the resealable opening 310 may comprise a zip-top utilizing interlocking plastic ridges. As a further non-limiting example, the resealable opening 310 may comprise a metal tab closure such that the top of the soap collection bag 300 may be rolled closed and metal tabs extending from both sides may be folded over to hold the soap collection bag 300 closed. In some embodiments, the bottom of the soap collection bag 300 may comprise a spout 320. The spout 320 may be an extension of the bottom of the soap collection bag 300. The spout 320 may be secured against the soap collection bag 300 until needed to empty the soap collection bag 300 for further processing of the contents of the soap collection bag 300. At that time, the tip of the spout 320 may be cut off to allow the contents of the soap collection bag 300 to flow or be forced out.

In use, the hanger 240 is coupled to the liquid soap dispenser 900 either by placing the plurality of hooks 215 into the plurality of mounting apertures 220 on the liquid soap dispenser 900 or by placing the net 225 over the top of the liquid soap dispenser 900. As the liquid soap dispenser 900 is used, the drips 915 that would have fallen upon the floor may be caught in the soap collection bag 300 that is suspended below the liquid soap dispenser 900.

The hanger 240 includes a hand rest 777 that is provided along a forward portion 778 of the hanger 240. A cross brace 779 extends between the left spring 260 and the right spring 265 to support the hand rest 777. When an end user utilizes the liquid soap dispenser 900, the hand rest 777 is depressed via the end user so as to form spacing requirements to insert a hand (not depicted) between the liquid soap dispenser 900 and the soap collection bag 300. Drips 915 that miss the hand of the end user (not depicted) fall directly into the soap collection bag 300.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, a "bag" is a container made of a flexible material. The bag has a single opening which allows the bag to receive the items to be contained.

As used in this disclosure, a "clip" is a fastener that attaches to an object by gripping or clasping the object. A clip is typically spring loaded.

As used herein, the words "couple", "couples", "coupled" or "coupling", refer to connecting, either directly or indirectly, and does not necessarily imply a mechanical connection.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the term "mesh" refers to an openwork fabric made from threads, yarns, cords, wires, strands, or lines that are woven, knotted, or otherwise twisted or intertwined at regular intervals. A mesh may also be referred to as a net.

As used in this disclosure, "orientation" refers to the positioning and/or angular alignment of a first object relative to a second object or relative to a reference position or reference direction.

As used in this disclosure, "resilient" or "semirigid" refer to an object or material which will deform when a force is applied to it and which will return to its original shape when the deforming force is removed.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, a "tab" is an extension of an object for the purpose of facilitating the manipulation of the object, identifying the object, or attaching the object to another object.

As used in this disclosure, "vertical" refers to a direction that is parallel to the local force of gravity. Unless specifically noted in this disclosure, the vertical direction is always perpendicular to horizontal.

As used herein, the word "waterproof" refers to an object that is not harmed when being exposed to water, including total submersion for a period of time. When used as a verb, "waterproof" refers to taking steps to make an object waterproof. Non-limiting examples of such steps may include applying special coatings or using gaskets to seal seams and entry points of an enclosure.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A soap dispenser drip catcher comprising:

a bag holder and a soap collection bag;

wherein the bag holder holds the soap collection bag below a liquid soap dispenser where the soap collection bag collects soap that drips from the liquid soap dispenser;

wherein the soap collection bag prevents the drips from contaminating a floor under the liquid soap dispenser;

wherein the bag holder comprises a hanger, a bag attachment, and a dispenser attachment;

wherein the hanger comprises a front frame and a rear frame;

wherein the front frame and the rear frame define a vertical separation distance between the liquid soap dispenser and the soap collection bag;

wherein the hanger is adapted to allow a hand of a user to receive the soap from the liquid soap dispenser by providing empty space between the liquid soap dispenser and the soap collection bag;

wherein the bag attachment removably couples the soap collection bag to the hanger;

wherein the bag attachment is further defined with a plurality of interlocking arms coupled to a bottom of the hanger;

wherein the plurality of interlocking arms are located at the front frame and the rear frame of the hanger;

wherein the front frame comprises a first U-shaped armature;

wherein the orientation of the front frame is such that an opening of the first U-shaped armature is at a top;

wherein two parallel vertical sides of the first U-shaped armature run from the top of the front frame to a bottom of the front frame where they couple to opposite sides of a horizontal cross brace which forms a bottom of the first U-shaped armature;

wherein the two parallel vertical sides of the first U-shaped armature are located on a right side and a left side of the front frame;

wherein the vertical height of the two parallel vertical sides of the first U-shaped armature are at least 2 inches long to provide access to the soap dispensed by the liquid soap dispenser.

2. The soap dispenser drip catcher according to claim 1 wherein the rear frame comprises a second U-shaped armature;

wherein the orientation of the rear frame is such that an opening of the U-shaped armature is at a top;

wherein two parallel vertical sides of the second U-shaped armature run from the top of the rear frame to a bottom of the rear frame where they couple to opposite sides of a horizontal cross brace which forms the bottom of the second U-shaped armature;

wherein the two parallel vertical sides of the second U-shaped armature are located on a right side and a left side of the rear frame;

wherein the vertical height of the two parallel vertical sides of the second U-shaped armature are at least 2 inches long to provide access to the soap dispensed by the liquid soap dispenser.

3. The soap dispenser drip catcher according to claim 2 wherein the hanger comprises a left spring and a right spring;

wherein the left spring extends upwardly from a left side of the front frame;

wherein the right spring extends upwardly from a right side of the front frame;

wherein the left spring and the right spring are vertically oriented along a front of the hanger;

wherein the left spring and the right spring enable the front portion of the hanger to rotate downwardly.

4. The soap dispenser drip catcher according to claim 3 wherein each of the plurality of interlocking arms are rotated away from one another to form a separation in the front frame or the rear frame, respectively;

wherein the separation of each of the plurality of interlocking arms enables the soap collection bag to be secured thereto or released therefrom;

wherein the soap collection bag is further defined with a top edge as well as a resealable opening;

wherein situated below the top edge, and along a first surface and a second surface of the soap collection bag is a sleeved member;

wherein the sleeved member extends along a width of the soap collection bag;

wherein the front frame and the rear frame slide into the sleeved member via the plurality of interlocking arms.

5. The soap dispenser drip catcher according to claim 4 wherein the front frame and the rear frame hold the top of the soap collection bag open so that the drips fall into the soap collection bag.

6. The soap dispenser drip catcher according to claim 5 wherein the bag holder couples the top of the hanger to the liquid soap dispenser.

7. The soap dispenser drip catcher according to claim 6 wherein the top ends of the front frame and the top ends of the rear frame bend 90 degrees towards the center of the liquid soap dispenser to form a plurality of hooks.

8. The soap dispenser drip catcher according to claim 7 wherein the plurality of hooks are inserted into a plurality of mounting apertures drilled or preformed in the sides of the liquid soap dispenser;

wherein the hanger hangs down from the liquid soap dispenser by the plurality of mounting apertures.

9. The soap dispenser drip catcher according to claim 6 wherein the hanger comprises a net;

wherein the net is a mesh fabric;

wherein the net couples to the top ends of the front frame and to the top ends of the rear frame;

wherein the net is placed over the top of the liquid soap dispenser and the hanger hangs from the net.

10. The soap dispenser drip catcher according to claim 6 wherein the soap collection bag is a flexible, waterproof container comprising a resealable opening.

11. The soap dispenser drip catcher according to claim 10 wherein the resealable opening comprises a zip-top utilizing interlocking plastic ridges.

12. The soap dispenser drip catcher according to claim 10 wherein the resealable opening comprises a metal tab closure such that the top of the soap collection bag is rolled closed and metal tabs extending from both sides are folded over to hold the soap collection bag closed.

13. The soap dispenser drip catcher according to claim 10 wherein a bottom of the soap collection bag comprises a spout;

wherein the spout is an extension of the bottom of the soap collection bag.

14. The soap dispenser drip catcher according to claim 13 wherein the spout is secured against the soap collection bag until needed to empty the soap collection bag for further processing of the contents of the soap collection bag;

wherein the tip of the spout is cut off to allow the contents of the soap collection bag to flow or be forced out.

15. The soap dispenser drip catcher according to claim 14 wherein the hanger includes a hand rest that is provided along a forward portion of the hanger;

wherein a cross brace extends between the left spring and the right spring to support the hand rest;

wherein the hand rest is depressed in order for an end user to retrieve soap;

drips that miss the end user fall directly into the soap collection bag.

* * * * *